US009149730B1

(12) United States Patent
Hauser

(10) Patent No.: US 9,149,730 B1
(45) Date of Patent: Oct. 6, 2015

(54) ACTION FIGURE DISPLAY KIT

(71) Applicant: R. Alex Hauser, Oak Harbor, WA (US)

(72) Inventor: R. Alex Hauser, Oak Harbor, WA (US)

( * ) Notice: Subject to any disclaimer, the term of this patent is extended or adjusted under 35 U.S.C. 154(b) by 0 days.

(21) Appl. No.: 14/249,078

(22) Filed: Apr. 9, 2014

(51) Int. Cl.
*A63H 3/50* (2006.01)
*F16M 11/22* (2006.01)

(52) U.S. Cl.
CPC . *A63H 3/50* (2013.01); *F16M 11/22* (2013.01)

(58) Field of Classification Search
USPC ..... 248/346.01, 346.03, 220.31; 273/236, 273/283, 285, 286, 287
See application file for complete search history.

(56) References Cited

U.S. PATENT DOCUMENTS 3,222,068 A 12/1965 Cowels, Jr.
4,211,410 A 7/1980 Smith
4,979,749 A * 12/1990 Onanian ..... 273/282.1
5,971,830 A 10/1999 Tobin
7,424,958 B1 * 9/2008 Eley ..... 211/70.6
7,861,860 B2 * 1/2011 Bettenhausen et al. ..... 206/370
2007/0290107 A1 * 12/2007 Lang et al. ..... 248/220.31

* cited by examiner

*Primary Examiner* — Steven Marsh
(74) *Attorney, Agent, or Firm* — Crossley Patent Law

(57) ABSTRACT

An action figure display kit includes a plurality of square shaped display boards having a top surface, a bottom surface, and four equidistant side surfaces, respectively. The kit including a plurality of connection dowels having a first end spaced apart from a second end. A plurality of dowel joints are disposed on each of the display boards. Each dowel joint is configured to removably receive the first, or second end of one of the connection dowels, therein. Three of the dowel joints are disposed on each of the respective side surfaces of each display board. A plurality of the dowel joints are disposed on the top surface of each display board. Each of the dowel joints of the top surface of each respective display board are spaced equidistantly. Each of the dowel joints of each respective side surface of each respective display board are also spaced equidistantly.

8 Claims, 4 Drawing Sheets

ACTION FIGURE DISPLAY KIT

BACKGROUND OF THE INVENTION

Various types of action figure display kit are known in the prior art. Many of these kits have static attachment mechanisms that only allow the user to display their action figures at predetermined positions. Thus, users are not free to select from various positions for displaying their action figures. These kits also lack interchangeability of display boards, such that a user cannot connect one display board having a stage of action figures, to another display board having a different stage of action figures. Further, these kits do not allow a user to engage each action figure directly with each other. Thus a user is able to engage a kick from one action figure with the kick of another action figure.

Whilst displaying action figures, being able to set up multiple stages of different action figures on different display boards, being able to interchange the display boards amongst each other, and being able to engage action figures directly with each other is critical to obtaining optimum versatility. Thus what is needed is an action figure display kit including a plurality of display boards, each display board having a plurality of dowel joints, a plurality of connection dowels, each connection dowel having a first end and a second end, wherein a plurality of configurations of display boards and action figures are made possible by combining the different elements about the plurality of connection dowels and dowel joints.

FIELD OF THE INVENTION

The present invention relates to a kit, and more particularly, to an action figure display kit.

SUMMARY OF THE INVENTION

The general purpose of the present action figure display kit, described subsequently in greater detail, is to provide an action figure display kit which has many novel features that result in an action figure display kit which is not anticipated, rendered obvious, suggested, or even implied by prior art, either alone or in combination thereof. The action figure display kit includes a plurality of square shaped display boards having a top surface, a bottom surface, and four equidistant side surfaces, respectively. The kit further includes a plurality of connection dowels. Each connection dowel has a first end spaced apart from a second end.

The kit further includes a plurality of dowel joints disposed on each of the display boards. Each dowel joint is configured to removably engage the first end, and alternately the second end, of one of the connection dowels therein. Three of dowel joints are disposed on each of the respective side surfaces and a plurality of dowel joints are disposed on the top surface of each display board. The dowel joints and connection dowels allow a user to combine multiple display boards together by engaging select dowel joints of the respective display boards with a selection of the connection dowels.

Each of the dowel joints of the top surface of each respective display board are spaced equidistantly. Further, each of the dowel joints of each respective side surface of each respective display board are spaced equidistantly.

Each of the first end and second end of the connection dowels is configured to fit into the dowel joints of the display boards. Additionally, Each of the first end and second end are also configured to reversibly engage an existent foot member aperture of an action figure toy. Thus, a user has control over the display of the action figure toy, because of the variety of possible configurations of the display boards, dowel joints, and connection dowels.

For instance, FIG. 4 shows a stage of two action figure toys, each action figure toy having two foot member apertures engaged with the top surface of the display board by the connection dowel and the dowel joint. A user is capable of creating one stage of action figures on several different display boards, and then interchanging the display boards to create several different combinations of action figure stages, as the user deems appropriate. A person having skill in the art would appreciate that each action figure toy could have just one foot member apertures engaged with the top surface of the display board by the connection dowel and the dowel joint, while the other foot member apertures of each action figure toy could be engaged with each other by the connection dowel and the foot member apertures. Thus, the kit allows a user to engage at least two action figures with the surface of the display board and with each other.

The dowel joints have a diameter of approximately 0.10 inches (2.5 mm) and a depth of approximately 0.12 inches (3.05 mm). The connection dowels have a length of approximately 0.24 inches (6.10 mm), and each of the first end and second end have a diameter of approximately 0.10 inches (2.5 mm). Thus, each of the dowel joints is configured to engage approximately the entire first end, and alternately the second end, of the connection dowel.

Each of the side surfaces is approximately 6 inches (152.4 mm), and is configured to fit into a standard action figure blister pack.

Thus has been broadly outlined the more important features of the present action figure display kit so that the detailed description thereof that follows may be better understood and in order that the present contribution to the art may be better appreciated.

Numerous objects, features and advantages of the present action figure display kit will be readily apparent to those of ordinary skill in the art upon reading the following detailed description of presently preferred, but nonetheless illustrative, examples of the present action figure display kit when taken in conjunction with the accompanying drawings.

BRIEF DESCRIPTION OF THE DRAWINGS

Figures

DETAILED DESCRIPTION OF THE DRAWINGS

Figure 1:
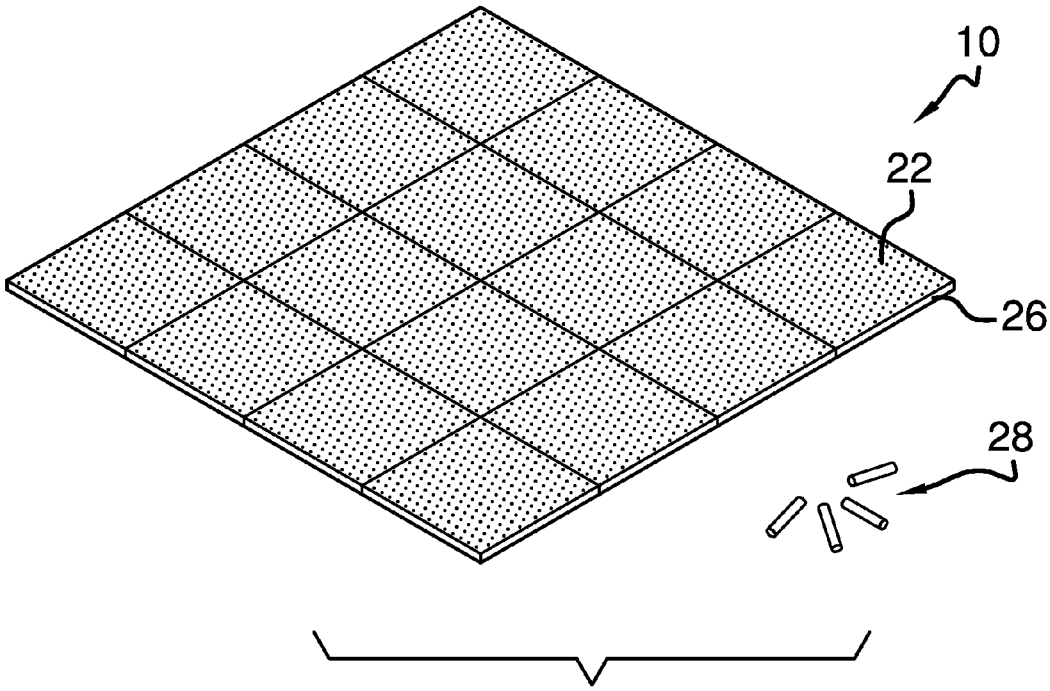
FIG. 1 is an isometric view.
Figure 2:
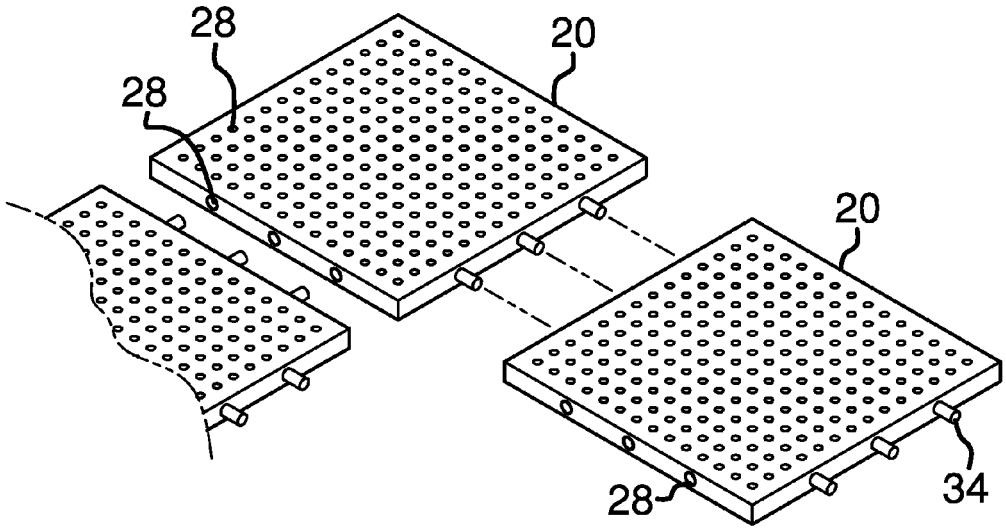
FIG. 2 is a detail view.
Figure 3:
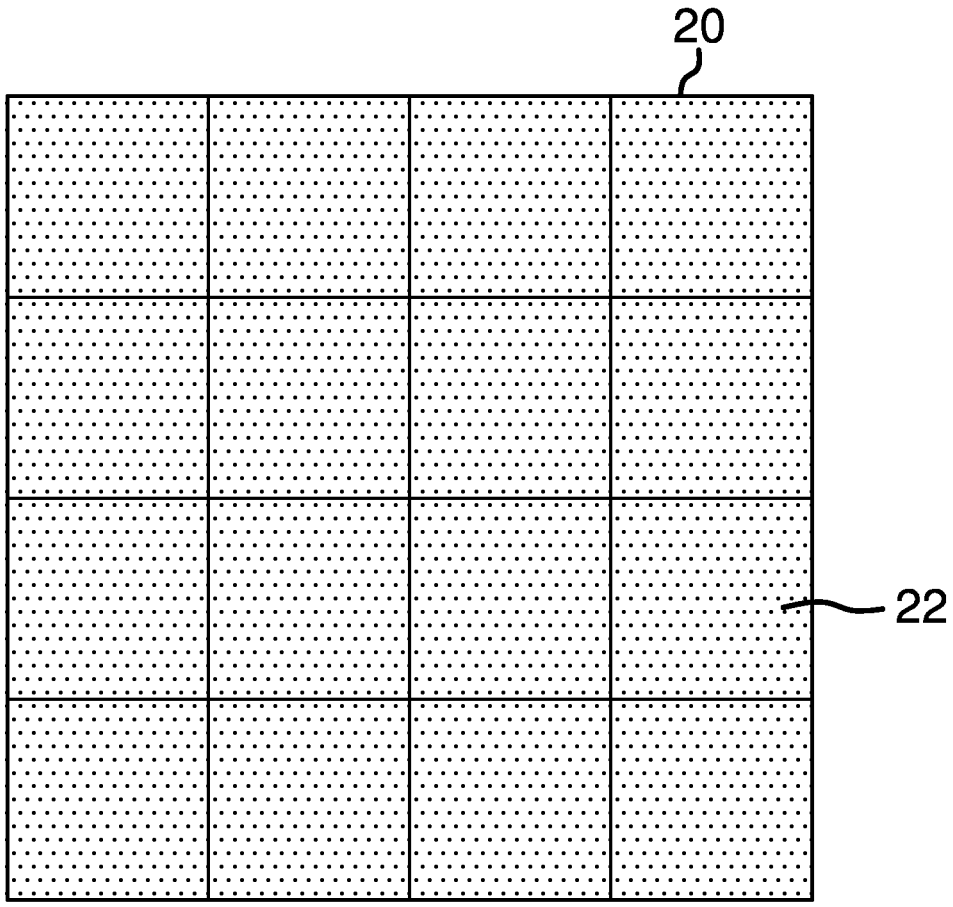
FIG. 3 is a top view.

With reference now to the drawings, and in particular FIGS. 1 through 6 thereof, the instant action figure display kit employing the principles and concepts of the present action figure display kit and generally designated by the reference number 10 will be described.

Referring to FIGS. 1 through 6 a preferred embodiment of the present action figure display kit 10 is illustrated. The action figure display kit 10 includes a plurality of square shaped display boards 20 having a top surface 22, a bottom surface 24, and four equidistant side surfaces 26, respectively. Each of the side surfaces 26 is approximately 6 inches (152.4 mm).

The kit further includes a plurality of connection dowels 28, each having a first end 30 spaced apart from a second end 32. The kit also includes a plurality of dowel joints 34 disposed on each of the display boards 20. Each dowel joint 34 is configured to removably engage the first end 30, and alternately the second end 32, of one of the connection dowels 28 therein. Three of dowel joints 34 are disposed on each of the respective side surfaces 26, and a plurality of dowel joints 34 are disposed on the top surface 22 of each display board 20. The dowel joints 34 and connection dowels 28 allow a user to combine multiple display boards 20 together by engaging select dowel joints 34 of the respective display boards with a selection of the connection dowels 28.

Each of the dowel joints 34 of the top surface 22 of each respective display board 20 are spaced equidistantly. Further, each of the dowel joints 34 of each respective side 26 surface of each respective display board 20 are spaced equidistantly.

Figure 4:
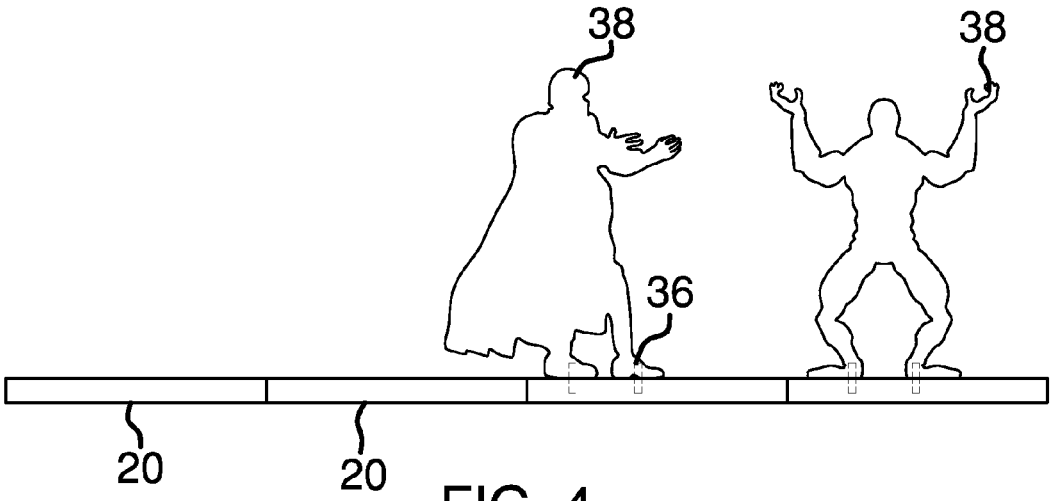
FIG. 4 is a side view of the kit in use.
Figure 5:
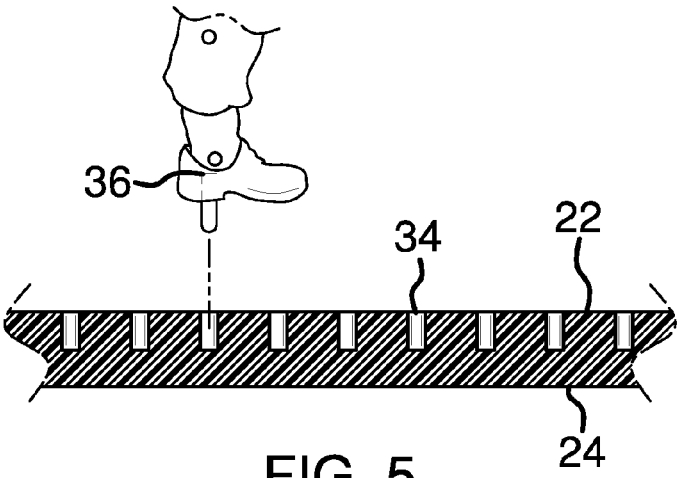
FIG. 5 is an enlarged side view of the kit in use.
Figure 6:
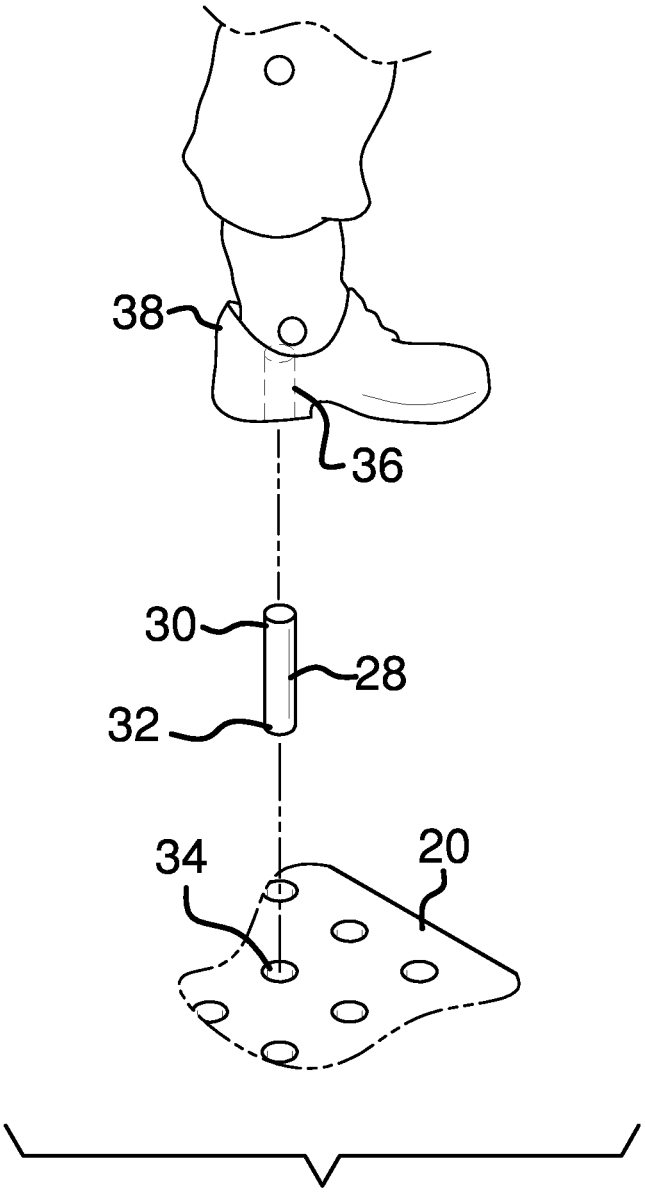
FIG. 6 is an exploded view of the kit in use view.

Each of the first end 30 and second end 32 of the connection dowels 28 is configured to fit into the dowel joints 34 of the display boards 20. Additionally, Each of the first end 30 and second end 32 are also configured to reversibly engage an existent foot member aperture 36 of an action figure toy 38. Thus, a user has control over the display of the action figure toy 38, because of the variety of possible configurations of the display boards 20, dowel joints 34, and connection dowels 28. For instance, FIG. 4 shows two action figure toys 38, each action figure toy 38 having two foot member apertures 36 engaged with the top surface of the display board by the connection dowel 28 and the dowel joint 34. The dowel joints 34 have a diameter of approximately 0.10 inches (2.5 mm) and a depth of approximately 0.12 inches (3.05 mm). The connection dowels 28 have a length of approximately 0.24 inches (6.10 mm), and each of the first end 30 and second end 32 have a diameter of approximately 0.10 inches (2.5 mm). Thus, each of the dowel joints 34 is configured to engage approximately the entire first end 30, and alternately the second end 32, of the connection dowel 28.

What is claimed is:

1. An action figure display kit comprising:

a plurality of square shaped display boards having a top surface, a bottom surface, and four equidistant side surfaces, respectively;

a plurality of connection dowels, each connection dowel having a first end spaced apart from a second end;

wherein the first end, and alternately the second end, of each of the plurality of connection dowels removably engages a foot member aperture of an action figure toy;

a plurality of dowel joints disposed on each of the display boards, each dowel joint configured to removably receive the first end, and alternately the second end, of one of the connection dowels therein;

three of the dowel joints disposed on each of the respective side surfaces of each display board; and a plurality of the dowel joints disposed on the top surface of each display board;

wherein each of the dowel joints of the top surface of each respective display board are spaced equidistantly; and wherein each of the dowel joints of each respective side surface of each respective display board are spaced equidistantly.

2. The action figure display kit of claim 1 wherein the dowel joints have a diameter of approximately 0.10 inches (2.5 mm).

3. The action figure display kit of claim 2 wherein the dowel joints have a depth of approximately 0.12 inches (3.05 mm).

4. The action figure display kit of claim 3 wherein the connection dowels have a length of approximately 0.24 inches (6.10 mm), and each of the first end and second end have a diameter of approximately 0.10 inches (2.5 mm).

5. The action figure display kit of claim 4 wherein each of the side surfaces is approximately 6 inches (152.4 mm).

6. The action figure display kit of claim 5 wherein the first end, and alternately the second end, of one of the connection dowels is irremovably disposed within each of the respective dowel joints of one of the respective side surfaces of each display board.

7. The action figure display kit of claim 6 wherein the first end, and alternately the second end, of one of the connection dowels is irremovably disposed within each of the respective dowel joints of two of the respective side surfaces of each display board.

8. An action figure display kit comprising:

a plurality of square shaped display boards having a top surface, a bottom surface, and four equidistant side surfaces, respectively;

a plurality of connection dowels, each connection dowel having a first end spaced apart from a second end;

wherein the first end, and alternately the second end, of each of the plurality of connection dowels removably engages a foot member aperture of an action figure toy;

a plurality of dowel joints disposed on each of the display boards, each dowel joint configured to removably receive the first end, and alternately the second end, of one of the connection dowels therein;

three of the dowel joints disposed on each of the respective side surfaces of each display board; and a plurality of the dowel joints disposed on the top surface of each display board;

wherein each of the dowel joints of the top surface of each respective display board are spaced equidistantly; and wherein each of the dowel joints of each respective side surface of each respective display board are spaced equidistantly;

wherein the dowel joints have a diameter of approximately 0.10 inches (2.5 mm), a depth of approximately 0.12 inches (3.05 mm);

wherein the connection dowels have a length of approximately 0.24 inches (6.10 mm), and each of the first end and second end have a diameter of approximately 0.10 inches (2.5 mm);

wherein each of the side surfaces is approximately 6 inches (152.4 mm); and wherein the first end, and alternately the second end, of one of the connection dowels is irremovably disposed within each of the respective dowel joints of one of the respective side surfaces of each display board.

* * * * *